US007271695B2

(12) United States Patent
Wadlington et al.

(10) Patent No.: US 7,271,695 B2
(45) Date of Patent: Sep. 18, 2007

(54) ELECTROMAGNETIC APPARATUS AND METHOD FOR MAKING A MULTI-PHASE HIGH FREQUENCY ELECTROMAGNETIC APPARATUS

(75) Inventors: James C. Wadlington, Austin, TX (US); James J. Hansen, Cedar Park, TX (US); Robert James Catalano, Mesquite, TX (US)

(73) Assignee: Tyco Electronics Power Systems, Inc., Mesquite, TX (US)

( * ) Notice: Subject to any disclaimer, the term of this patent is extended or adjusted under 35 U.S.C. 154(b) by 87 days.

(21) Appl. No.: 11/212,550

(22) Filed: Aug. 27, 2005

(65) Prior Publication Data

US 2007/0046415 A1 Mar. 1, 2007

(51) Int. Cl.
*H01F 27/24* (2006.01)
*H01F 7/06* (2006.01)

(52) U.S. Cl. ..... 336/214; 336/212; 336/215; 29/602.1

(58) Field of Classification Search ..... 336/180–184, 336/212, 178, 214–215; 29/602.1, 605
See application file for complete search history.

(56) References Cited

U.S. PATENT DOCUMENTS

2003/0038696 A1* 2/2003 Chui et al. ..... 336/198
2004/0239463 A1* 12/2004 Poniatowski et al. ..... 336/10

* cited by examiner

*Primary Examiner*—Anh Mai
(74) *Attorney, Agent, or Firm*—Law Office of Donald D. Mondul

(57) ABSTRACT

An electromagnetic apparatus includes: (a) A magnetic material arranged in a core structure establishing a first flux path set and a second flux path set; the first flux path set includes a first middle flux path oriented about a first axis and two first side flux paths parallel with the first axis; the second flux path set includes a second middle flux path oriented about a second axis and two second side flux paths parallel with the second axis; the second axis is perpendicular with the first axis. The first and second flux path sets cooperate to establish open spaces. Each open space is bounded by portions of two flux paths from each of the first and second flux path sets. (b) A plurality of windings for conducting electrical current about the magnetic core structure. The windings are oriented around one axis on both sides of the other axis.

20 Claims, 5 Drawing Sheets

ELECTROMAGNETIC APPARATUS AND METHOD FOR MAKING A MULTI-PHASE HIGH FREQUENCY ELECTROMAGNETIC APPARATUS

BACKGROUND OF THE INVENTION

The present invention is directed to electromagnetic apparatuses, and especially to electromagnetic apparatuses employing a plurality of windings for handling multiple phases. Electromagnetic apparatuses that handle a plurality of winding currents are useful in many products, such as by way of example and not by way of limitation, multi-phase DC-DC converter products and AC-DC converter products.

In products employing electromagnetic apparatuses, as with many products in today's market, size of products is ever smaller. Responding to pressure to reduce product size is manifested in reduction in the sizes of components in products. Electromagnetic apparatuses using cores and windings to establish electromagnetic fields are among the bulkiest of components and are difficult to reduce in size because of the physics involved in their design. That is, $$B \sim L\frac{I}{NA} \quad [1]$$

Where, L=inductance

B=magnetic flux;

I=inductor current;

N=number of turns; and

A=cross-section area of core.

The physical size of a core-and-windings construction, affected by such factors as cross-section area and number of turns, in an electromagnetic apparatus or component directly bears upon the parameters that contribute to the proper operation of a product. Size may also be reduced by providing alternate core paths for AC (Alternating Current) and DC (Direct Current) currents within a compounded core structure. Multi-phase electromagnetic products further resist size reduction because they require a plurality of core-and-windings constructed devices.

There is a need for a reduced-size compact structure for an electromagnetic apparatus.

There is a need for a reduced-size compact structure for an electromagnetic apparatus that can support multi-phase operations.

SUMMARY OF THE INVENTION

An electromagnetic apparatus includes: (a) A magnetic material arranged in a core structure establishing a first flux path set and a second flux path set; the first flux path set includes a first middle flux path oriented about a first axis and two first side flux paths parallel with the first axis; the second flux path set includes a second middle flux path oriented about a second axis and two second side flux paths parallel with the second axis; the second axis is perpendicular with the first axis. The first and second flux path sets cooperate to establish open spaces. Each open space is bounded by portions of two flux paths from each of the first and second flux path sets. (b) A plurality of windings for conducting electrical current about the magnetic core structure. The windings are oriented around one axis on both sides of the other axis.

It is, therefore, an object of the present invention to provide a reduced-size compact structure for an electromagnetic apparatus.

It is a further object of the present invention to provide a reduced-size compact structure for an electromagnetic apparatus that can support multi-phase operations.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

Figure 1:
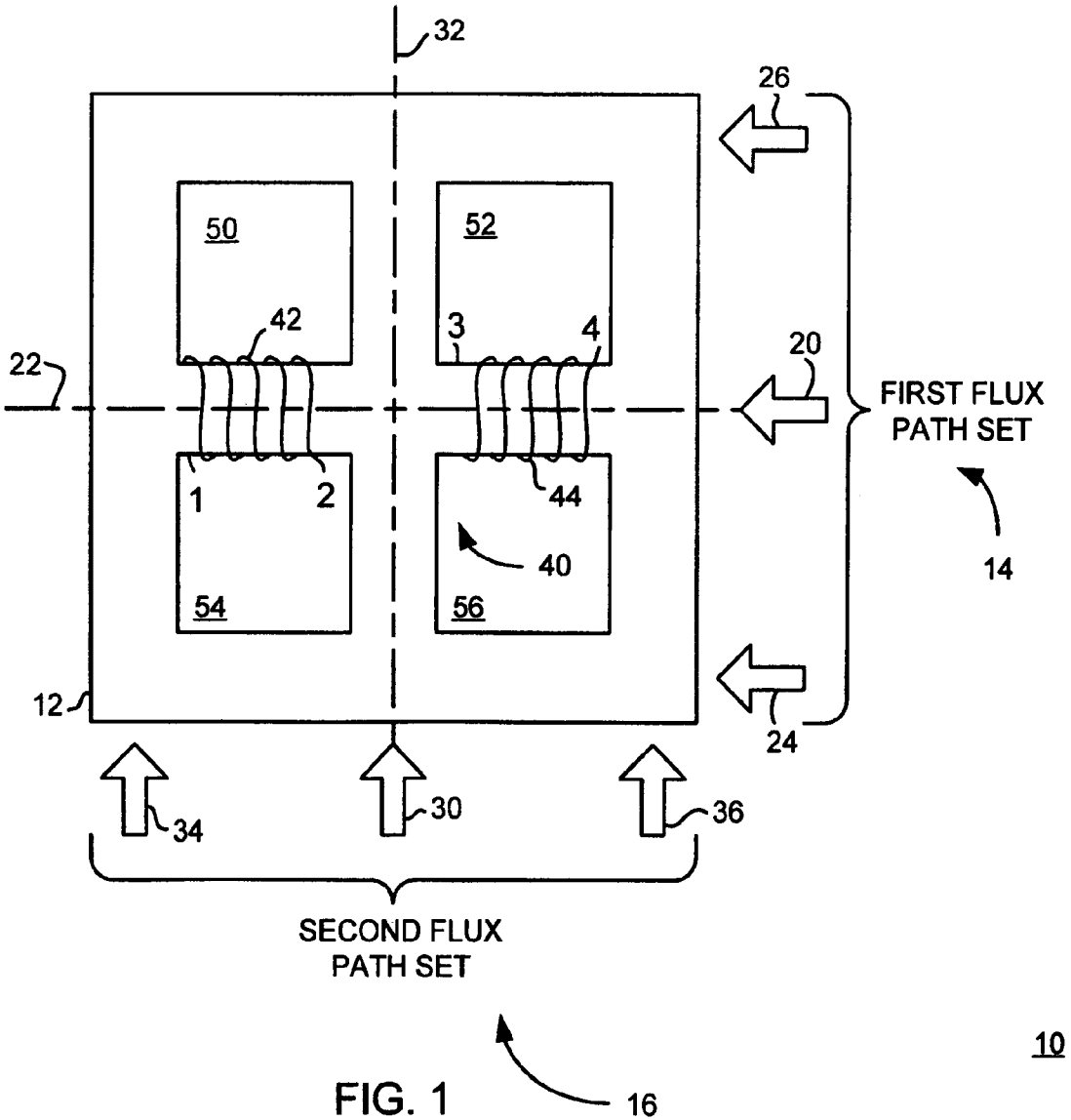
FIG. 1 is a schematic plan view of an electromagnetic apparatus configured according to the present invention.

FIG. 1 is a schematic plan view of an electromagnetic apparatus configured according the present invention. In FIG. 1, an electromagnetic apparatus 10 includes a core structure 12 of magnetic material. Core structure 12 establishes a first flux path set 14 and a second flux path set 16. First flux path set 14 includes a first middle flux path 20 generally oriented about a first axis 22 and first side flux paths 24, 26 generally parallel with first axis 22. Second flux path set 16 includes a second middle flux path 30 generally oriented about a second axis 32 and second side flux paths 34, 36 generally parallel with second axis 32.

A plurality of windings 40 includes a first winding 42 and a second winding 44. Windings 42, 44 are wound about core structure 12 at first middle flux path 20 and generally oriented about first axis 22. Windings 42, 44 are situated on opposite sides of second axis 32. Second middle flux path 30 operates as a magnetic shunt for magnetic fields established when windings 42, 44 are energized with an electrical current. Winding 42 is energized by applying electrical current to winding 42 using leads 1 and 2. Winding 44 is energized by applying electrical current to winding 44 using leads 3 and 4.

An aperture or opening 50 is established that is bounded by portions of core structure 12 contained in first middle flux path 20, first side flux path 26, second middle flux path 30 and second side flux path 34. An aperture or opening 52 is established that is bounded by portions of core structure 12 contained in first middle flux path 20, first side flux path 26, second middle flux path 30 and second side flux path 36. An aperture or opening 54 is established that is bounded by portions of core structure 12 contained in first middle flux path 20, first side flux path 24, second middle flux path 30 and second side flux path 34. An aperture or opening 56 is established that is bounded by portions of core structure 12 contained in first middle flux path 20, first side flux path 24, second middle flux path 30 and second side flux path 36. Apertures or openings 50, 52, 54, 56 extend through core structure 12.

Prior art electromagnetic devices use side flux paths, such as first side flux paths 22, 26, to effect the desired electromagnetic structure for use in a product. Electromagnetic apparatus 10 uses a middle flux path, such as first middle flux path 20, to establish the required multi-phase electromagnetic core-and-winding structure required to support single-phase or multi-phase operations. Apertures 50, 52, 54, 56 accommodate windings 42, 44 so that electromagnetic apparatus 10 does not extend beyond the limits of core structure 12 in a plane substantially containing axes 22, 32.

By this construction windings 42, 44 accommodate multi-phase operation on a single core structure 12 (using only one of windings 42, 44 supports single-phase operation) and significant space is saved by employing electromagnetic apparatus 10 rather than using two or more core-and-winding structures (i.e., one for each phase), as would be required when employing prior art electromagnetic apparatuses.

Any portion of core structure 12 may be shaped in any of several cross-sections including by way of example and not by way of limitation, elliptical, circular, rectangular, square, triangular or another polygonal cross-section.

Figure 2:
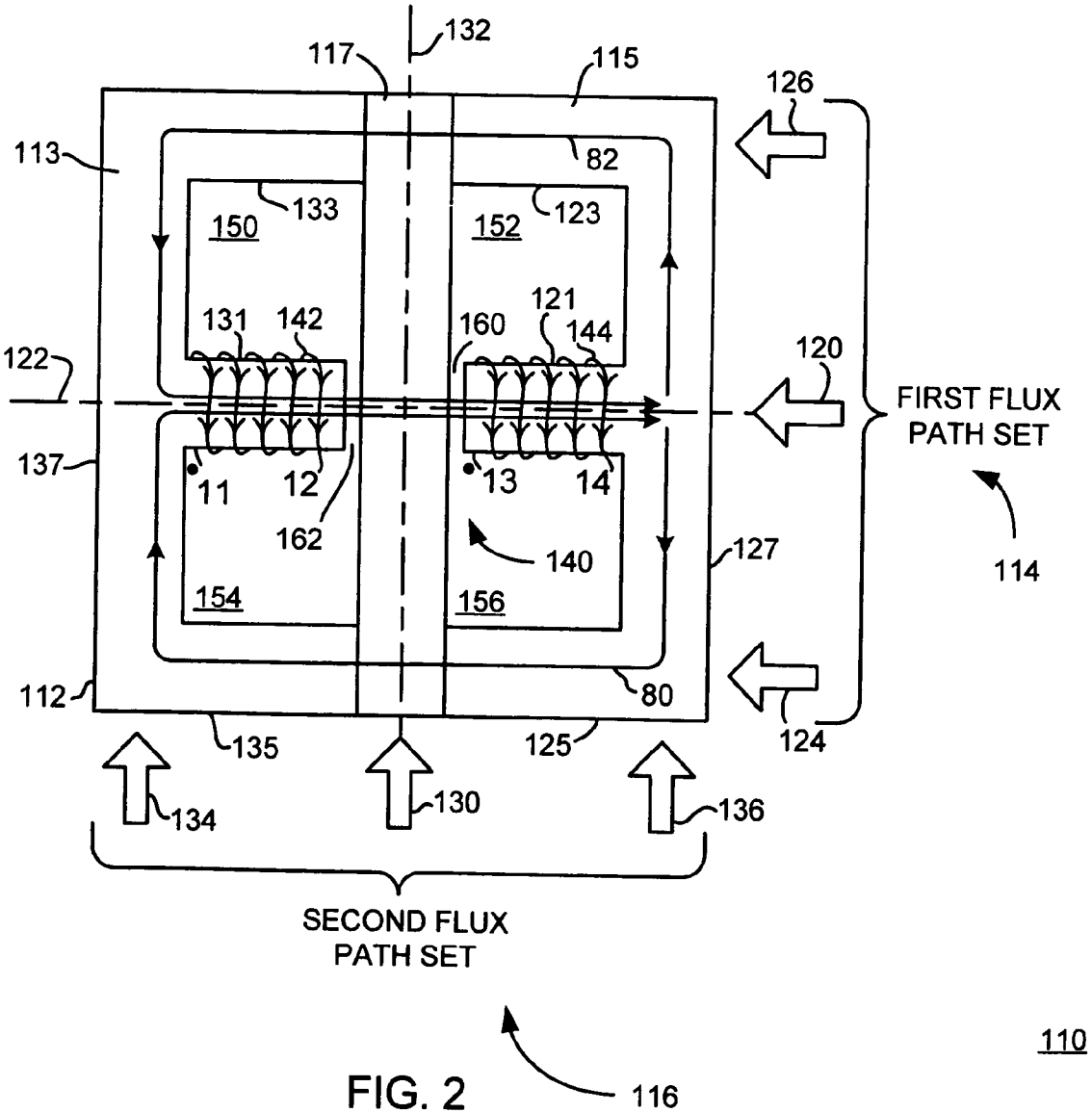
FIG. 2 is a schematic plan view of an alternate embodiment electromagnetic apparatus configured using a windings-aiding orientation according to the present invention.

FIG. 2 is a schematic plan view of an alternate embodiment electromagnetic apparatus configured using a windings-aiding orientation according to the teachings of the present invention. In FIG. 2, an electromagnetic apparatus 110 includes a core structure 112 of magnetic material. Core structure 112 establishes a first flux path set 114 and a second flux path set 116. First flux path set 114 includes a first middle flux path 120 generally oriented about a first axis 122 and first side flux paths 124, 126 generally parallel with first axis 122. Second flux path set 116 includes a second middle flux path 130 generally oriented about a second axis 132 and second side flux paths 134, 136 generally parallel with second axis 132.

Core 112 is constructed using a first E-shaped core portion 113 in facing relation with a second E-shaped core portion 115, First E-shaped core portion 113 has a base portion 137 from which depend a middle leg 131 flanked by side legs 133, 135. Second E-shaped core portion 115 has a base portion 127 from which depend a middle leg 121 flanked by side legs 123, 125. A bar-shaped core portion 117 is situated between E-shaped core portions 113, 115. Bar-shaped core portion 117 is in substantially abutting relation with side legs 123, 133 and is in substantially abutting relation with side legs 125, 135. Middle leg 121 does not abut bar-shaped core portion 117 and establishes a gap 160 between middle leg 121 and bar-shaped core portion 117. Middle leg 131 does not abut bar-shaped core portion 117 and establishes a gap 162 between middle leg 131 and bar-shaped core portion 117.

A plurality of windings 140 includes a first winding 142 and a second winding 144. Windings 142, 144 are wound about core structure 112 at middle legs 121, 131 and are generally oriented about first axis 122. Windings 142, 144 are situated on opposite sides of second axis 132. Bar-shaped core portion 117 operates as a magnetic shunt for magnetic fields established when windings 142, 144 are energized with an electrical current. Winding 142 is energized by applying electrical current to winding 142 using leads 11 and 12. Winding 144 is energized by applying electrical current to winding 144 using leads 13 and 14.

An aperture or opening 150 is established that is bounded by middle leg 131, side leg 133 and base portion 137. An aperture or opening 152 is established that is bounded by middle leg 121, side leg 123 and base portion 127. An aperture or opening 154 is established that is bounded by middle leg 131, side leg 135 and base portion 137. An aperture or opening 156 is established that is bounded by middle leg 121, side leg 125 and base portion 127. Apertures or openings 150, 152, 154, 156 extend through core structure 112.

Prior art electromagnetic devices use side flux paths (i.e., flux paths using outer legs of a core), such as first side flux paths 124, 126, to effect the desired electromagnetic structure for use in a product. Electromagnetic apparatus 110 uses a middle flux path, such as first middle flux path 120, to establish the required multi-phase electromagnetic core-and-winding structure required to support single-phase or multi-phase operations. Apertures 150, 152, 154, 156 accommodate windings 142, 144 so that electromagnetic apparatus 110 does not extend beyond the limits of core structure 112 in a plane substantially containing axes 122, 132.

By this construction windings 142, 144 accommodate multi-phase operation on a single core structure 112 (using only one of windings 142, 144 supports single-phase operation) and significant space is saved by employing electromagnetic apparatus 110 rather than using two or more core-and-winding structures (i.e., one for each phase), as would be required when employing prior art electromagnetic apparatuses.

Any portion of core structure 112 may be shaped in any of several cross-sections including by way of example and not by way of limitation, elliptical, circular, rectangular, square, triangular or another polygonal cross-section.

Gaps 160, 162 permit use of electromagnetic apparatus in DC (direct current) applications without core structure 112 saturating. By comparison, if electromagnetic apparatus 10 (FIG. 1) is used for a DC application, core structure 12 will saturate, thereby rendering electromagnetic apparatus 10 substantially inefficient in its operation.

When electromagnetic apparatus 110 is energized so that leads 11, 13 are in phase (indicated by black dots next to leads 11, 13), electromagnetic apparatus 110 is said to be configured in a windings-aiding orientation. That is, when leads 11, 13 are in phase as illustrated in FIG. 2 flux lines 80, 82 are established as illustrated in FIG. 2; flux lines 80, 82 are in an series—aiding orientation—supporting each other—in middle legs 121, 131 and are in series—opposing orientation in core portion 117.

Figure 3:
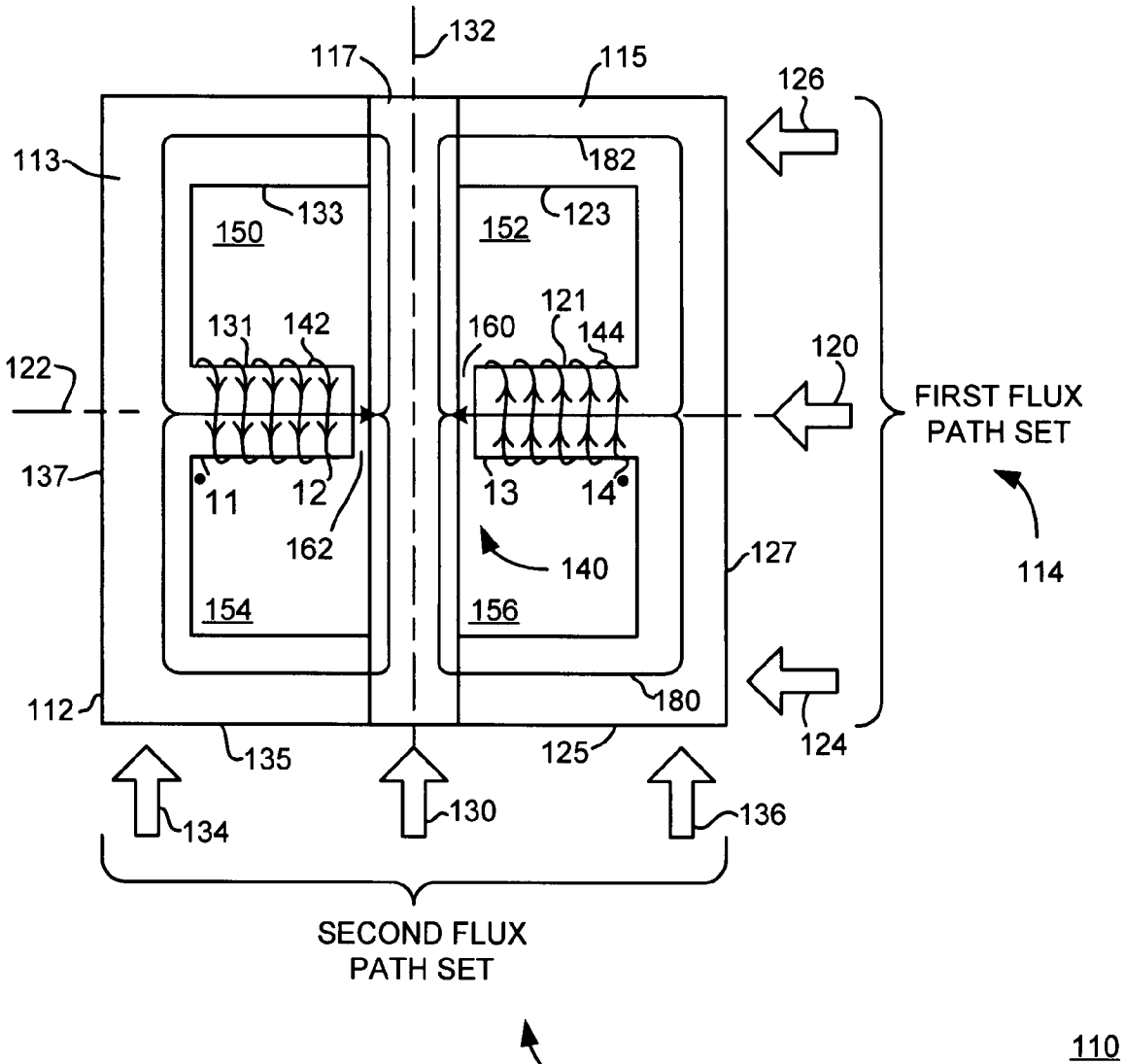
FIG. 3 is a schematic plan view of the alternate embodiment electromagnetic apparatus illustrated in FIG. 2, configured using a windings-opposing orientation.

FIG. 3 is a schematic plan view of the alternate embodiment electromagnetic apparatus illustrated in FIG. 2, configured using a windings-opposing orientation. In FIG. 3, like elements vis-à-vis FIG. 2 are indicated with like reference numerals. In FIG. 3, an electromagnetic apparatus 110 includes a core structure 112 of magnetic material. Core structure 112 establishes a first flux path set 114 and a second flux path set 116. First flux path set 114 includes a first middle flux path 120 generally oriented about a first axis 122 and first side flux paths 124, 126 generally parallel with first axis 122. Second flux path set 116 includes a second middle flux path 130 generally oriented about a second axis 132 and second side flux paths 134, 136 generally parallel with second axis 132.

Core 112 is constructed using a first E-shaped core portion 113 in facing relation with a second E-shaped core portion 115. First E-shaped core portion 113 has a base portion 137 from which depend a middle leg 131 flanked by side legs 133, 135. Second E-shaped core portion 115 has a base portion 127 from which depend a middle leg 121 flanked by side legs 123, 125. A bar-shaped core portion 117 is situated between E-shaped core portions 113, 115. Bar-shaped core portion 117 is in substantially abutting relation with side legs 123, 133 and is in substantially abutting relation with side legs 125, 135. Middle leg 121 does not abut bar-shaped core portion 117 and establishes a gap 160 between middle leg 121 and bar-shaped core portion 117. Middle leg 131 does not abut bar-shaped core portion 117 and establishes a gap 162 between middle leg 131 and bar-shaped core portion 117.

A plurality of windings 140 includes a first winding 142 and a second winding 144. Windings 142, 144 are wound about core structure 112 at middle legs 121, 131 and are generally oriented about first axis 122. Windings 142, 144 are situated on opposite sides of second axis 132. Bar-shaped core portion 117 operates as a magnetic shunt for magnetic fields established when windings 142, 144 are energized with an electrical current. Winding 142 is energized by applying electrical current to winding 142 using leads 11 and 12. Winding 144 is energized by applying electrical current to winding 144 using leads 13 and 14.

An aperture or opening 150 is established that is bounded by middle leg 131, side leg 133 and base portion 137. An aperture or opening 152 is established that is bounded by middle leg 121, side leg 123 and base portion 127. An aperture or opening 154 is established that is bounded by middle leg 131, side leg 135 and base portion 137. An aperture or opening 156 is established that is bounded by middle leg 121, side leg 125 and base portion 127. Apertures or openings 150, 152, 154, 156 extend through core structure 112.

Any portion of core structure 112 may be shaped in any of several cross-sections including by way of example and not by way of limitation, elliptical, circular, rectangular, square, triangular or another polygonal cross-section.

Gaps 160, 162 permit use of electromagnetic apparatus in DC (direct current) applications without core structure 112 saturating. By comparison, if electromagnetic apparatus 10 (FIG. 1) is used for a DC application, core structure 12 will saturate, thereby rendering electromagnetic apparatus 10 substantially inefficient in its operation.

When electromagnetic apparatus 110 is energized so that leads 11, 14 are in phase (indicated by black dots next to leads 11, 14), electromagnetic apparatus 110 is said to be configured in a windings-opposing orientation. That is, when leads 11, 14 are in phase as illustrated in FIG. 3 flux lines 180, 182 are established as illustrated in FIG. 3; flux lines 180, 182 are in a series—opposing orientation—operating against each other—in middle legs 121, 131 and are in series aiding orientation in core portion 117.

Figure 4:
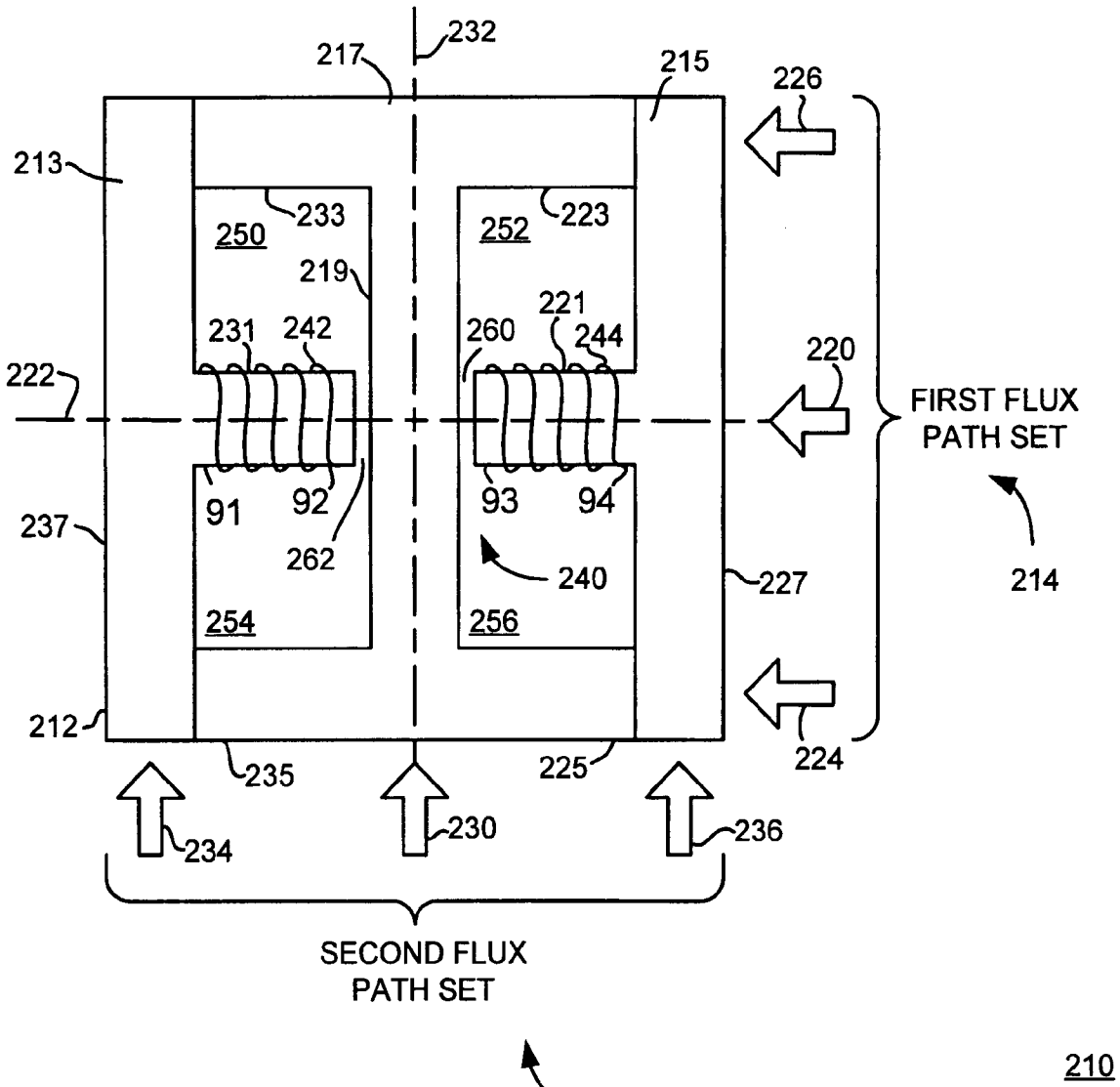
FIG. 4 is a schematic plan view of a second alternate embodiment electromagnetic apparatus configured according to the present invention.

FIG. 4 is a schematic plan view of a second alternate embodiment electromagnetic apparatus configured according to the teachings of the present invention. In FIG. 4, an electromagnetic apparatus 210 includes a core structure 212 of magnetic material. Core structure 212 establishes a first flux path set 214 and a second flux path set 216. First flux path set 214 includes a first middle flux path 220 generally oriented about a first axis 222 and first side flux paths 224, 226 generally parallel with first axis 222. Second flux path set 216 includes a second middle flux path 230 generally oriented about a second axis 232 and second side flux paths 234, 236 generally parallel with second axis 232.

Core 212 is constructed using a first T-shaped core portion 213 in facing relation with a second T-shaped core portion 215. First T-shaped core portion 213 has a base portion 231 upon which is situated a cross-bar portion 237 substantially perpendicular with base portion 231. Second T-shaped core portion 215 has a base portion 221 upon which is situated a cross-bar portion 227 substantially perpendicular with base portion 221. An I-shaped core portion 217 is situated between T-shaped core portions 213, 215. I-shaped core portion 217 has a base portion 219 from which depend legs 223, 233 and from which depend legs 225, 235. Legs 223, 225, 233, 235 are substantially perpendicular with base portion 219. Legs 223, 225 are in substantially abutting relation with cross-bar portion 227. Legs 233, 235 are in substantially abutting relation with cross-bar portion 237. Base portion 221 does not abut I-shaped core portion 217 and establishes a gap 260 between base portion 221 and I-shaped core portion 217. Base portion 231 does not abut I-shaped core portion 217 and establishes a gap 262 between base portion 231 and I-shaped core portion 217.

A plurality of windings 240 includes a first winding 242 and a second winding 244. Windings 242, 244 are wound about core structure 212 at base portions 221, 231 and are generally oriented about first axis 222. Windings 242, 244 are situated on opposite sides of second axis 232. I-shaped core portion 217 operates as a magnetic shunt for magnetic fields established when windings 242, 244 are energized with an electrical current. Winding 242 is energized by applying electrical current to winding 242 using leads 91 and 92. Winding 244 is energized by applying electrical current to winding 244 using leads 93 and 94.

An aperture or opening 250 is established that is bounded by base portion 231, leg 233, cross-bar portion 237 and base portion 219. An aperture or opening 252 is established that is bounded by base portion 221, leg 223, cross-bar portion 227 and base portion 219. An aperture or opening 254 is established that is bounded by base portion 231, leg 235, cross-bar portion 237 and base portion 219. An aperture or opening 256 is established that is bounded by base portion 221, leg 225, cross-bar portion 227 and base portion 219. Apertures or openings 250, 252, 254, 256 extend through core structure 212.

Prior art electromagnetic devices use side flux paths, such as first side flux paths 222, 226, to effect the desired electromagnetic structure for use in a product. Electromagnetic apparatus 210 uses a middle flux path, such as first middle flux path 220, to establish the required multi-phase electromagnetic core-and-winding structure required to support single-phase or multi-phase operations. Apertures 250, 252, 254, 256 accommodate windings 242, 244 so that electromagnetic apparatus 210 does not extend beyond the limits of core structure 212 in a plane substantially containing axes 222, 232.

By this construction windings 242, 244 accommodate multi-phase operation on a single core structure 212 (using only one of windings 242, 244 supports single-phase operation) and significant space is saved by employing electromagnetic apparatus 210 rather than using two or more core-and-winding structures (i.e., one for each phase), as would be required when employing prior art electromagnetic apparatuses.

Any portion of core structure 212 may be shaped in any of several cross-sections including by way of example and not by way of limitation, elliptical, circular, rectangular, square, triangular or another polygonal cross-section.

Gaps 260, 262 permit use of electromagnetic apparatus in DC (direct current) applications without core structure 212 saturating. By comparison, if electromagnetic apparatus 10 (FIG. 1) is used for a DC application, core structure 12 will saturate, thereby rendering electromagnetic apparatus 10 substantially inefficient in its operation.

One skilled in the art of electromagnetic apparatus design will recognize that electromagnetic apparatus 210 is similar to electromagnetic apparatus 110 (FIGS. 2 and 3) at least in so far as electromagnetic apparatus 210 may be energized so that leads 91, 93 are in phase to configure electromagnetic apparatus 210 in a windings-aiding orientation or electromagnetic apparatus 210 may energized so that leads 91, 94 are in phase to configure electromagnetic apparatus 210 in a windings-opposing orientation, substantially as described above in connection with FIGS. 2 and 3.

Figure 5:
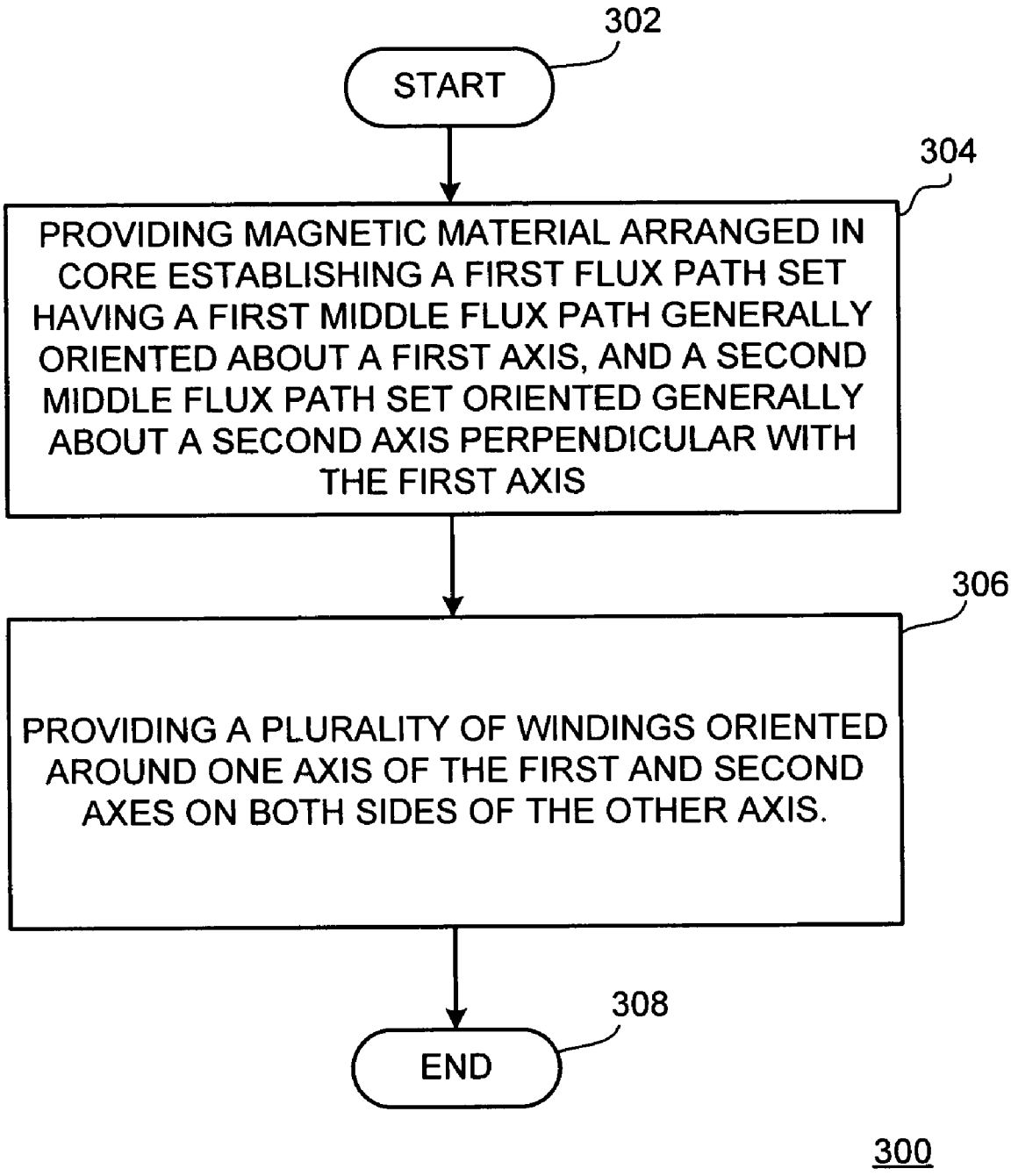
FIG. 5 is a flow chart illustrating the method of the present invention.

FIG. 5 is a flow chart illustrating the method of the present invention. In FIG. 5, a method 300 for making an electromagnetic apparatus begins at a START locus 302. Method 300 continues with the step of providing a magnetic material arranged in a core structure, as indicated by a block 304. The core structure establishes a first flux path set and a second flux path set. The first flux path set includes a first middle flux path generally oriented about a first axis and two first side flux paths generally parallel with the first axis. The second flux path set includes a second middle flux path generally oriented about a second axis and two second side flux paths generally parallel with the second axis. The second axis is generally perpendicular with the first axis. The first flux path set and the second flux path set cooperate to establish a plurality of open spaces. Each respective open space of the plurality of open spaces is bounded by portions of two respective flux paths from each of the first flux path set and the second flux path set.

Method 300 continues with the step of providing a plurality of windings for conducting electrical current about the magnetic core structure, as indicated by a block 306. The plurality of windings is oriented around one axis of the first axis and the second axis on both sides of the other axis of the first axis and the second axis. Method 300 terminates at an END locus 308.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. An electromagnetic apparatus comprising:

(a) a magnetic material arranged in a core structure; said core structure establishing a first flux path set and a second flux path set; said first flux path set comprising a first middle flux path generally oriented about a first axis and two first side flux paths generally parallel with said first axis; said second flux path set comprising a second middle flux path generally oriented about a second axis and two second side flux paths generally parallel with said second axis; said second axis being generally perpendicular with said first axis; said first flux path set and said second flux path set cooperating to establish a plurality of open spaces; each respective open space of said plurality of open spaces being bounded by portions of two respective flux paths from each of said first flux path set and said second flux path set; and (b) a plurality of windings for conducting electrical current about said magnetic core structure; said plurality of windings being wound around one axis of said first axis and said second axis on both sides of the other axis of said first axis and said second axis.

2. An electromagnetic apparatus as recited in claim 1 wherein said one axis is said first axis and wherein said magnetic material establishes a material gap between said first middle flux path and said second middle flux path on each side of said second axis.

3. An electromagnetic apparatus as recited in claim 1 wherein said plurality of windings is two windings; a first winding of said two windings being oriented on a first side of said second axis; a second winding of said two windings being oriented on a second side of said second axis opposite said first side of said second axis.

4. An electromagnetic apparatus as recited in claim 2 wherein said plurality of windings is two windings; a first winding of said two windings being oriented on a first side of said second axis; a second winding of said two windings being oriented on a second side of said second axis opposite said first side of said second axis.

5. An electromagnetic apparatus as recited in claim 1 wherein said core structure is configured using a first E-shaped core section, a second E-shaped core section and a third substantially parallelepiped-shaped core section; said first E-shaped core section having a first base member establishing one of said second side flux paths and three first depending members depending from one side of said first base member establishing a portion of said first flux path set; said second E-shaped core section having a second base member establishing the other of said second side flux paths than said one second side flux path and three second depending members depending from one side of said second base member toward said first E-shaped core section establishing a portion of said first flux path set; said third substantially parallelepiped-shaped core section being situated between said first depending members and said second depending members to establish said second middle flux path.

6. An electromagnetic apparatus as recited in claim 5 wherein said third substantially parallelepiped-shaped core section is in substantially abutting relationship with first and second depending members cooperating with said third substantially parallelepiped-shaped core section to establish said two first side flux paths.

7. An electromagnetic apparatus as recited in claim 6 wherein said third substantially parallelepiped-shaped core section is in spaced relationship with one said first depending member and one said second depending member cooperating with said third substantially parallelepiped-shaped core section to establish said first middle flux path.

8. An electromagnetic apparatus as recited in claim 1 wherein said core structure is configured using a first T-shaped core section, a second T-shaped core section and a third substantially I-shaped core section; said first T-shaped core section having a first base member establishing one of said second side flux paths and a first depending member depending from one side of said first base member establishing a portion of said first middle flux path; said second T-shaped core section having a second base member establishing the other of said second side flux paths than said one second side flux path and a second depending member depending from one side of said second base member toward said first T-shaped core section establishing a portion of said first middle flux path; said third substantially I-shaped core section being situated between said first T-shaped core section and said second T-shaped core section to establish said second middle flux path and said two first side flux paths.

9. An electromagnetic apparatus as recited in claim 8 wherein said third substantially I-shaped core section is in substantially abutting relationship with first and second base members cooperating.

10. An electromagnetic apparatus as recited in claim 9 wherein said third substantially I-shaped core section is in spaced relationship with first and second depending members cooperating with said third substantially I-shaped core section to establish said first middle flux path.

11. An electromagnetic apparatus comprising:

(a) a plurality of magnetic core modules arranged in a core structure; said core structure establishing a first flux path set and a second flux path set; said first flux path set comprising a first middle flux path generally oriented about a first axis and two first side flux paths generally parallel with said first axis; said second flux path set comprising a second middle flux path generally oriented about a second axis and two second side flux paths generally parallel with said second axis; said second axis being generally perpendicular with said first axis; said first flux path set and said second flux path set cooperating to establish a plurality of open spaces; each respective open space of said plurality of open spaces being bounded by portions of two respective flux paths from each of said first flux path set and said second flux path set; and (b) a plurality of windings for conducting electrical current about said magnetic core structure; said plurality of windings being wound around one axis of said first axis and said second axis on both sides of the other axis of said first axis and said second axis.

12. An electromagnetic apparatus as recited in claim 11 wherein said one axis is said first axis and wherein said magnetic material establishes a material gap between said first middle flux path and said second middle flux path on each side of said second axis.

13. An electromagnetic apparatus as recited in claim 11 wherein said plurality of windings is two windings; a first winding of said two windings being oriented on a first side of said second axis; a second winding of said two windings being oriented on a second side of said second axis opposite said first side of said second axis.

14. An electromagnetic apparatus as recited in claim 12 wherein said plurality of windings is two windings; a first winding of said two windings being oriented on a first side of said second axis; a second winding of said two windings being oriented on a second side of said second axis opposite said first side of said second axis.

15. An electromagnetic apparatus as recited in claim 11 wherein said core modules comprise a first E-shaped core section, a second E-shaped core section and a third substantially parallelepiped-shaped core section; said first E-shaped core section having a first base member establishing one of said second side flux paths and three first depending members depending from one side of said first base member establishing a portion of said first flux path set; said second E-shaped core section having a second base member establishing the other of said second side flux paths than said one second side flux path and three second depending members depending from one side of said second base member toward said first E-shaped core section establishing a portion of said first flux path set; said third substantially parallelepiped-shaped core section being situated between said first depending members and said second depending members to establish said second middle flux path.

16. An electromagnetic apparatus as recited in claim 15 wherein said third substantially parallelepiped-shaped core section is in substantially abutting relationship with first and second depending members cooperating with said third substantially parallelepiped-shaped core section to establish said two first side flux paths.

17. An electromagnetic apparatus as recited in claim 16 wherein said third substantially parallelepiped-shaped core section is in spaced relationship with one said first depending member and one said second depending member cooperating with said third substantially parallelepiped-shaped core section to establish said first middle flux path.

18. A method for making an electromagnetic apparatus; the method comprising the steps of:

(a) providing a magnetic material arranged in a core structure; said core structure establishing a first flux path set and a second flux path set; said first flux path set comprising a first middle flux path generally oriented about a first axis and two first side flux paths generally parallel with said first axis; said second flux path set comprising a second middle flux path generally oriented about a second axis and two second side flux paths generally parallel with said second axis; said second axis being generally perpendicular with said first axis; said first flux path set and said second flux path set cooperating to establish a plurality of open spaces; each respective open space of said plurality of open spaces being bounded by portions of two respective flux paths from each of said first flux path set and said second flux path set; and (b) providing a plurality of windings for conducting electrical current about said magnetic core structure; said plurality of windings being wound around one axis of said first axis and said second axis on both sides of the other axis of said first axis and said second axis.

19. A method for making an electromagnetic apparatus as recited in claim 18 wherein said plurality of windings is two windings; a first winding of said two windings being oriented on a first side of said second axis; a second winding of said two windings being oriented on a second side of said second axis opposite said first side of said second axis.

20. A method for making an electromagnetic apparatus as recited in claim 19 wherein said core structure is configured using a first E-shaped core section, a second E-shaped core section and a third substantially parallelepiped-shaped core section; said first E-shaped core section having a first base member establishing one of said second side flux paths and three first depending members depending from one side of said first base member establishing a portion of said first flux path set; said second E-shaped core section having a second base member establishing the other of said second side flux paths than said one second side flux path and three second depending members depending from one side of said second base member toward said first E-shaped core section establishing a portion of said first flux path set; said third substantially parallelepiped-shaped core section being situated between said first depending members and said second depending members to establish said second middle flux path.

* * * * *